US010789802B2

(12) United States Patent
Tsuji et al.

(10) Patent No.: US 10,789,802 B2
(45) Date of Patent: Sep. 29, 2020

(54) PAPER SHEET PROCESSING DEVICE AND PARTITION CARD

(71) Applicant: LAUREL PRECISION MACHINES CO., LTD., Osaka (JP)

(72) Inventors: Keiji Tsuji, Saitama (JP); Akiyoshi Kuroe, Kawaguchi (JP); Junji Ebine, Urayasu (JP); Makoto Nakamura, Okegawa (JP); Toru Inake, Kasukabe (JP)

(73) Assignee: LAUREL PRECISION MACHINES CO., LTD., Osaka (JP)

( * ) Notice: Subject to any disclaimer, the term of this patent is extended or adjusted under 35 U.S.C. 154(b) by 0 days.

(21) Appl. No.: 15/332,094

(22) Filed: Oct. 24, 2016

(65) Prior Publication Data

US 2017/0116810 A1 Apr. 27, 2017

(30) Foreign Application Priority Data

Oct. 27, 2015 (JP) ..... 2015-210567

(51) Int. Cl.
*G07D 11/00* (2006.01)
*B65H 5/00* (2006.01)
(Continued)

(52) U.S. Cl.
CPC ..... *G07D 11/18* (2019.01); *B65H 3/063* (2013.01); *B65H 5/006* (2013.01); *B65H 7/02* (2013.01);
(Continued)

(58) Field of Classification Search
CPC .. B65H 2701/1211; B65H 2701/12112; B65H 2701/1867; B65H 2511/514;
(Continued)

(56) References Cited

U.S. PATENT DOCUMENTS 4,629,311 A 12/1986 Kaneko et al.
5,917,930 A * 6/1999 Kayani ..... G07D 11/0066 209/534
(Continued)

FOREIGN PATENT DOCUMENTS

CN 1969289 A 5/2007
CN 101714270 A 5/2010
(Continued)

OTHER PUBLICATIONS

Extended European Search Report dated Mar. 27, 2017 in European Application No. 16195506.7 (7 pages).
(Continued)

*Primary Examiner* — Patrick Cicchino
(74) *Attorney, Agent, or Firm* — Nixon & Vanderhye P.C.

(57) ABSTRACT

A paper sheet processing device includes: a charging inlet that takes in paper sheets in a conveyance direction, the paper sheets including at least one target sheet and a partition card overlapped on the target sheet, the partition card having a main surface portion having at least one identification hole group, the identification hole group having at least two through holes arranged along the conveyance direction; a detection unit that detects take-in of the paper sheets by the charging unit, and detects the identification hole group; and a control unit that determines a paper sheet is the partition card in a case where the identification hole group has been detected by the detection unit, and determines that a paper sheet is the target sheet in a case where the identification hole group has not been detected by the detection unit.

5 Claims, 8 Drawing Sheets

(51) Int. Cl.

| | |
|---|---|
| ***B65H 7/02*** | (2006.01) |
| ***B65H 3/06*** | (2006.01) |
| ***B65H 39/11*** | (2006.01) |
| ***B65H 33/04*** | (2006.01) |
| ***G07D 11/14*** | (2019.01) |
| ***G07D 11/22*** | (2019.01) |
| ***G07D 11/18*** | (2019.01) |
| ***G07D 11/24*** | (2019.01) |
| ***B65H 39/115*** | (2006.01) |
| *G07D 11/50* | (2019.01) |

(52) U.S. Cl.
CPC ..... *B65H 33/04* (2013.01); *B65H 39/11* (2013.01); *B65H 39/115* (2013.01); *G07D 11/14* (2019.01); *G07D 11/22* (2019.01); *G07D 11/24* (2019.01); *B65H 2511/415* (2013.01); *B65H 2511/514* (2013.01); *B65H 2553/822* (2013.01); *B65H 2701/1211* (2013.01); *B65H 2701/12112* (2013.01); *B65H 2701/18267* (2013.01); *B65H 2701/1912* (2013.01); *G07D 11/50* (2019.01)

(58) Field of Classification Search
CPC ..... B65H 39/11; B65H 39/115; B65H 33/04; B65H 7/02; G07D 11/0084; G07D 11/0033; G07D 11/0054
See application file for complete search history.

(56) References Cited

U.S. PATENT DOCUMENTS

| | | | | |
|---|---|---|---|---|
| 6,955,263 | B2 * | 10/2005 | Steinkogler | G07D 11/0096 209/534 |
| 7,016,767 | B2 * | 3/2006 | Jones | G07D 11/0084 700/224 |
| 7,133,741 | B2 * | 11/2006 | Matzig | B65H 33/04 270/1.03 |
| 7,422,117 | B2 * | 9/2008 | Myatt | G07D 11/0087 194/206 |
| 7,849,994 | B2 * | 12/2010 | Klein | G07D 11/0051 194/206 |
| 7,980,394 | B2 * | 7/2011 | Otsuka | G07D 11/0018 194/206 |
| 8,311,665 | B2 * | 11/2012 | Uesaka | B65H 33/04 194/206 |
| 8,556,254 | B2 * | 10/2013 | Sakoguchi | B65H 3/063 271/165 |
| 8,701,857 | B2 * | 4/2014 | Jenrick | G07D 7/00 194/206 |
| 9,058,710 | B2 * | 6/2015 | Jacomet | G07D 11/0036 |
| 9,238,565 | B2 * | 1/2016 | Miyashita | B07C 3/18 |
| 2007/0205256 | A1 * | 9/2007 | Uno | B65H 39/10 235/375 |
| 2010/0032476 | A1 | 2/2010 | Möckli | |
| 2013/0060375 | A1 | 3/2013 | Sato | |
| 2014/0284864 | A1 | 9/2014 | Miyashita | |

FOREIGN PATENT DOCUMENTS

| | | | |
|---|---|---|---|
| JP | 2007-79695 | | 3/2007 |
| JP | 2009-187156 | A | 8/2009 |
| JP | 2011-8653 | A | 1/2011 |
| RU | 2 273 599 | C2 | 4/2006 |
| RU | 2009 117 756 | A | 11/2010 |

OTHER PUBLICATIONS

Decision to Grant a Patent for an Invention, dated Feb. 2, 2018 in Russian Application No. 2016141860, with English Translation (26 pages).
Chinese Office Action dated Oct. 31, 2018 in Chinese Application No. 201610941342.2, with partial English Translation (Search Report only), 9 pages.
Notice of Grounds of Rejection dated Sep. 21, 2018 in Korean Application No. 10-2016-0139452, with English Translation (10 pages).
Notice of Reasons for Rejection dated Feb. 26, 2019 in Japanese Application No. 2015-210567, with English translation (6 pages).

* cited by examiner

PAPER SHEET PROCESSING DEVICE AND PARTITION CARD

BACKGROUND OF THE INVENTION

Field of the Invention

The present invention relates to a paper sheet processing device and a partition card.

Priority is claimed on Japanese Patent Application No. 2015-210567, filed Oct. 27, 2015, the content of which is incorporated herein by reference.

Description of Related Art

There is conventionally known a paper sheet processing device that batch processes at least two groups of paper sheets to be processed, each of which forms a batch processing unit, while classifying them with partition cards. For example, in the paper sheet processing device of Japanese Unexamined Patent Application No. 2007-079695 (hereinafter Patent Document 1), there is installed a color detecting unit constituted by color sensors, with a colored region provided on a partition card. By detecting the colored region of a partition card by the color detecting unit, the partition card is distinguished from a paper sheet to classify each group of paper sheets to be processed.

SUMMARY OF THE INVENTION

However, in the paper sheet processing device of Patent Document 1, since it is necessary to provide a color detecting unit, there is a risk of a cost increase.

An object of the present invention is to provide a paper sheet processing device and partition card that can inhibit a cost increase.

A paper sheet processing device according to a first aspect of the present invention includes: a charging inlet that takes in paper sheets in a conveyance direction, the paper sheets including at least one target sheet and a partition card overlapped on the target sheet, the partition card having a main surface portion having at least one identification hole group, the identification hole group having at least two through holes arranged along the conveyance direction; a detection unit that detects take-in of the paper sheets by the charging unit, and detects the identification hole group; and a control unit that determines a paper sheet take-in of which have been detected by the detection unit is the partition card in a case where the identification hole group has been detected by the detection unit, the control unit determining that a paper sheet take-in of which have been detected by the detection unit is the target sheet in a case where the identification hole group has not been detected by the detection unit.

A partition card according to a second aspect of the present invention includes: a main surface portion having at least one identification hole group, the identification hole group having at least two through holes arranged along a conveyance direction. The partition card is taken-in in the conveyance direction by a charging inlet of a paper sheet processing device. The identification hole group is detected by a detection unit of the paper sheet processing device. The partition card is identified by a control unit of the paper sheet processing in a case where the identification hole group has been detected by the detection unit of the paper sheet processing device.

According to the paper sheet processing device according to the first aspect of the present invention, the charging inlet takes in paper sheets including at least one target sheet and a partition card, the detection unit detects the take-in of the paper sheets by the charging inlet, and detects the identification hole group having at least two through holes provided in the main surface portion of the partition card and arranged along the conveyance direction. The control unit that determines a paper sheet take-in of which have been detected by the detection unit is the partition card in a case where the identification hole group has been detected by the detection unit. The control unit determines that a paper sheet take-in of which have been detected by the detection unit is the target sheet in a case where the identification hole group has not been detected by the detection unit. In this way, the detection unit is made to detect the presence of the identification hole group. Therefore, it is possible to lower the cost of a constitution for identifying the partition sheet and the target sheet. Accordingly, it is possible to simplify and downsize the constitution for identifying the partition card and the target sheet.

According to the partition card according to the second aspect of the present invention, the partition card is taken-in in the conveyance direction by the charging inlet of a paper sheet processing device, and the identification hole group is detected by the detection unit of the paper sheet processing device. The partition card is identified by the control unit of the paper sheet processing. In this way, since the detection unit is made to detect the presence of the identification hole group, there is a reduction in the cost of the constitution for identifying bills to be processed. Accordingly, it is possible to hold down a cost increase of the paper sheet processing device. Moreover, it is possible to achieve a simplification and downsizing of the constitution for classifying the partition sheet from a target sheet.

DETAILED DESCRIPTION OF THE INVENTION

An embodiment of the present invention is described below with reference to the drawings. A paper sheet processing device 11 according to the present embodiment shown in FIG. 1 performs predetermined processing of paper sheets S that are charged thereto. Specifically, the paper sheet processing device 11 performs identification processing on bills S (a) to be processed (target sheets) shown in FIG. 2 as the processing target. The bills S (a) to be processed are paper sheets S. The paper sheet processing device 1 identifies the bills S (a) to be processed and counts by denomination to calculate the total monetary amount.

Figure 1:
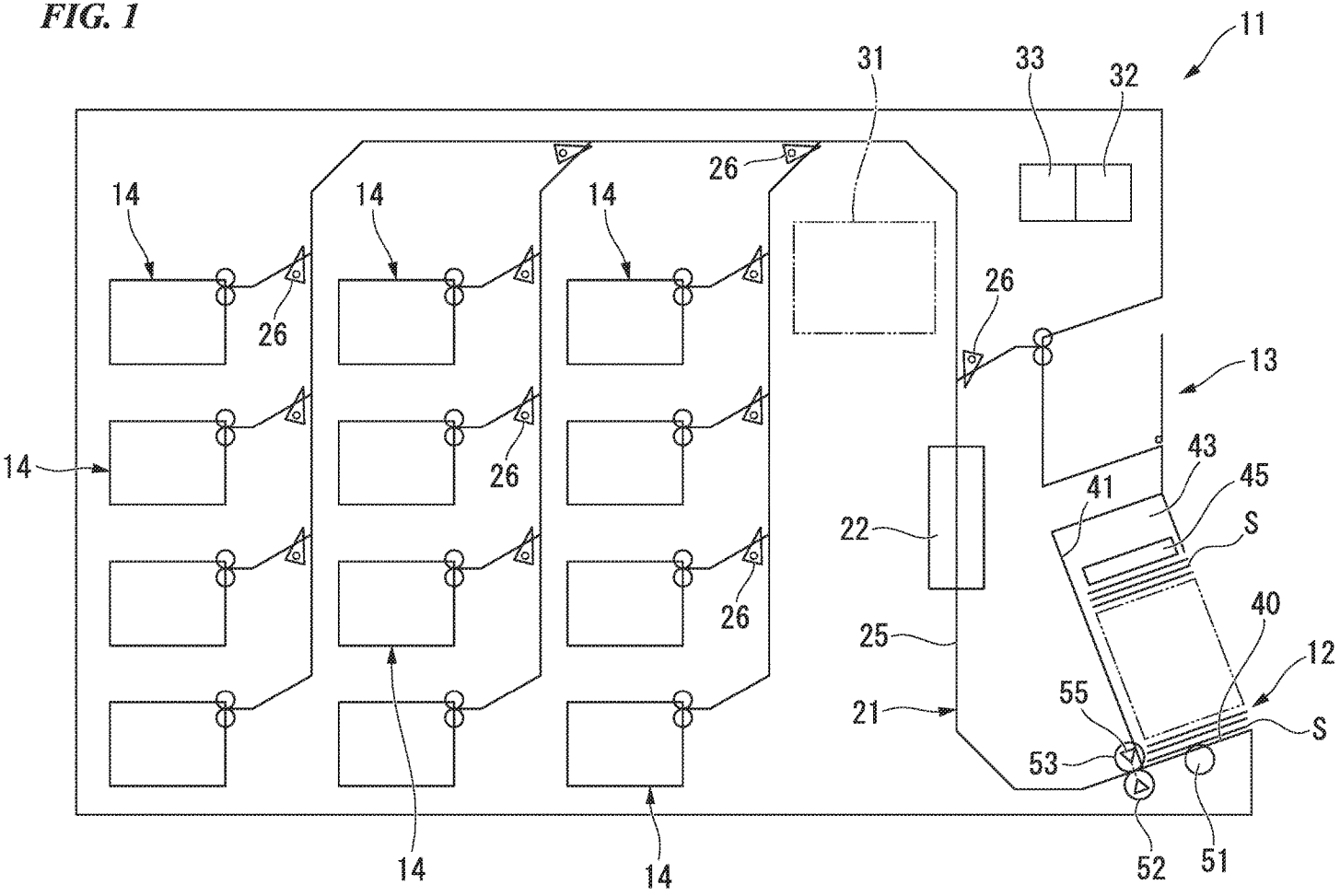
FIG. 1 is an outline configuration drawing of a paper sheet processing device according to an embodiment of the present invention viewed from the front side.
Figure 2:
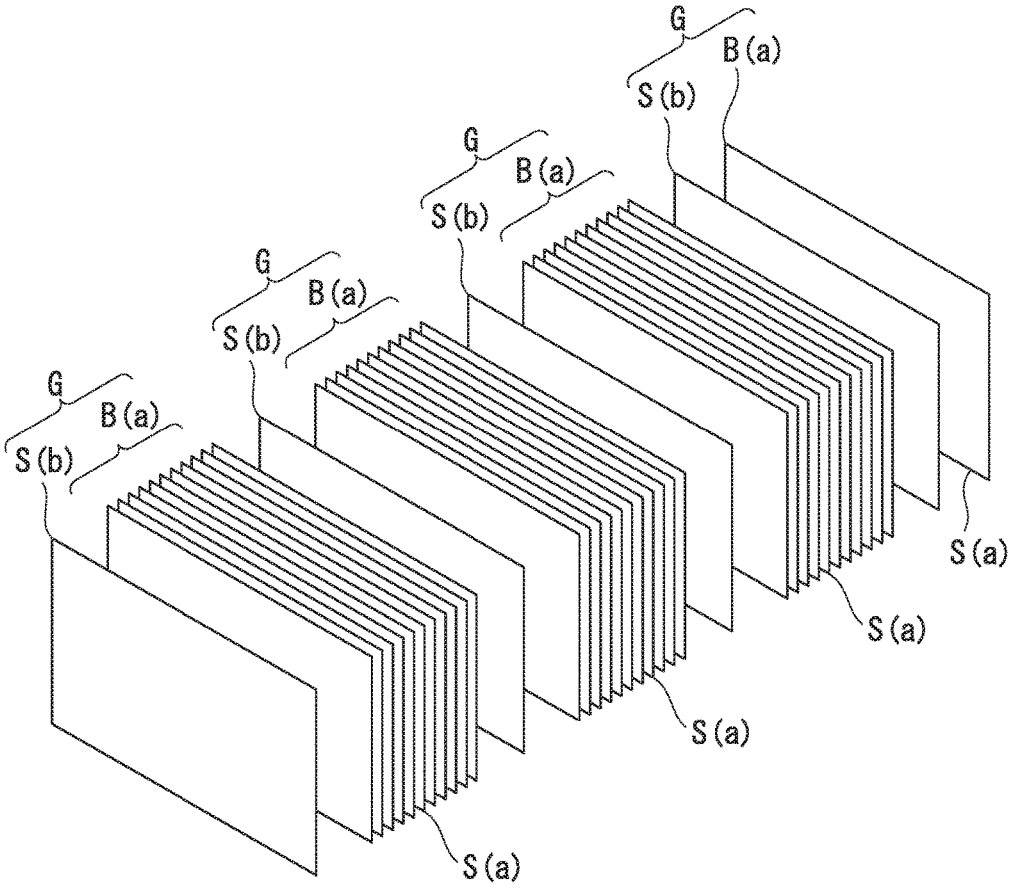
FIG. 2 a perspective view showing paper sheets to be processed by the paper sheet processing device according to the embodiment of the present invention.

As shown in FIG. 2, the paper sheet processing device 11 shown in FIG. 1 processes a plurality of sections B (a) in succession. Each of the sections B (a) includes a plurality of bills S (a) to be processed that are continuously accumulated in the thickness direction and bundled. In doing so, there is used a partition card S (b) for judging the boundary of each section B (a), in other words, for classifying each section B (a). The partition card S (b) is a paper sheet S.

Here, each section B (a) includes bills S (a) to be processed that are bundled for each batch processing unit. The section B (a) often includes a plurality of the bills S (a) to be processed that have been continuously accumulated in the thickness direction and bundled as described above. However, the section B (a) may include only one bill S (a) to be processed.

As shown in FIG. 2, a partition card S (b) is used for determining the boundary between one section B (a) that includes a plurality of the bills S (a) to be processed of a batch processing unit and another section B (a) that includes a plurality of the bills S (a) to be processed of a batch processing unit. A partition card S (b) is also used for determining the boundary between one section B (a) that includes a single bill S (a) to be processed of a batch processing unit and another section B (a) that includes a single bill S (a) to be processed of a batch processing unit. Furthermore, a partition card S (b) is also used for determining the boundary between one section B (a) that includes a single bill S (a) to be processed of one batch processing unit and another section B (a) that includes a plurality of the bills S (a) to be processed of a batch processing unit. Thereby, at least two paper sheet groups U, each constituted by at least one bill S (a) to be processed and a partition card S (b) that is arranged overlapping this at least one bill S (a) to be processed, can be set together in the paper sheet processing device 11. The paper sheet processing device 11 is capable of continuously processing these at least two paper sheet groups G.

As shown in FIG. 1, the paper sheet processing device 11 includes a charging inlet 12, a reject unit 13, and a plurality of (specifically, 12) accumulation units 14. The charging inlet 12 is provided at the lower portion of the right-side surface and opens to the right side. The reject unit 13 is provided in the middle portion in the vertical direction of the same right-side surface and opens to only the right side or both the right side and front. The plurality of accumulation units 14 are arranged to the left of the charging inlet 12 and the reject unit 13 and open to the front surface of the device.

The paper sheets S are set in the charging inlet 12 in the state of being accumulated in the vertical direction (that is, the charging inlet 12 receives the paper sheets S accumulated in the vertical direction), and the charging inlet 12 separates and feeds the set paper sheets S one at a time from the lowest one, whereby the paper sheets S are taken into the paper sheet processing device 11. The paper sheet processing device 11 includes, in the inside, a conveying unit 21 and an identifying unit 22 that are provided in the inside thereof. The conveying unit 21 conveys the paper sheets S that have been taken in from the charging inlet 12. The identifying unit 22 identifies the paper sheets S being conveyed by the conveying unit 21 and counts the bills S (a) to be processed among the paper sheets S while identifying the denominations thereof.

The portion of the conveying unit 21 on the downstream side of the identifying unit 22 selectively sorts the paper sheets to the reject unit 13 and the plurality of accumulation units 14 on the basis of the identification result of the identifying unit 22. The conveying unit 21 includes a conveyance path 25 and a plurality of sorting units 26. The conveyance path 25 is arranged separated in an appropriate manner so as to link each unit, and conveys the paper sheets S. The sorting units 26 are provided at each branch position of the conveyance path 25 and sort the paper sheets S.

Among the bills S (a) to be processed taken into the paper sheet processing device 11 by the charging inlet 12, the reject unit 13 excludes in a manner removable from the paper sheet processing device 11 the paper sheets S including bills S (a) to be rejected that have been identified as being other than authentic bills by the identifying unit 22. The reject unit 13 accumulates from bottom to top the paper sheets S fed out from the conveying unit 21 in the order they are fed out (in other words, in the take-in order of the charging inlet 12).

Among the bills S (a) to be processed taken into the paper sheet processing device 11 by the charging inlet 12, the plurality of accumulation units 14 accumulate in a manner removable from the paper sheet processing device 11 the authentic bills S (a) to be processed that have been identified as authentic by the identifying unit 22. Each of the plurality of accumulation units 14 accumulates from bottom to top the bills S (a) to be processed fed out from the conveying unit 21 in the order they are fed out (in other words, in the take-in order of the charging inlet 12).

The paper sheet processing device 11 includes an operation display unit 31 provided on the front surface of the paper sheet processing device 11. The operation display unit 31 accepts operation inputs and displays information. The paper sheet processing device 11 includes a control unit 32 and a storage unit 33 provided inside of the paper sheet processing device 11. The control unit 32 controls each unit. The storage unit 33 stores master data that serves as the basis of identification, data of the results of identification, and the like.

Figure 3:
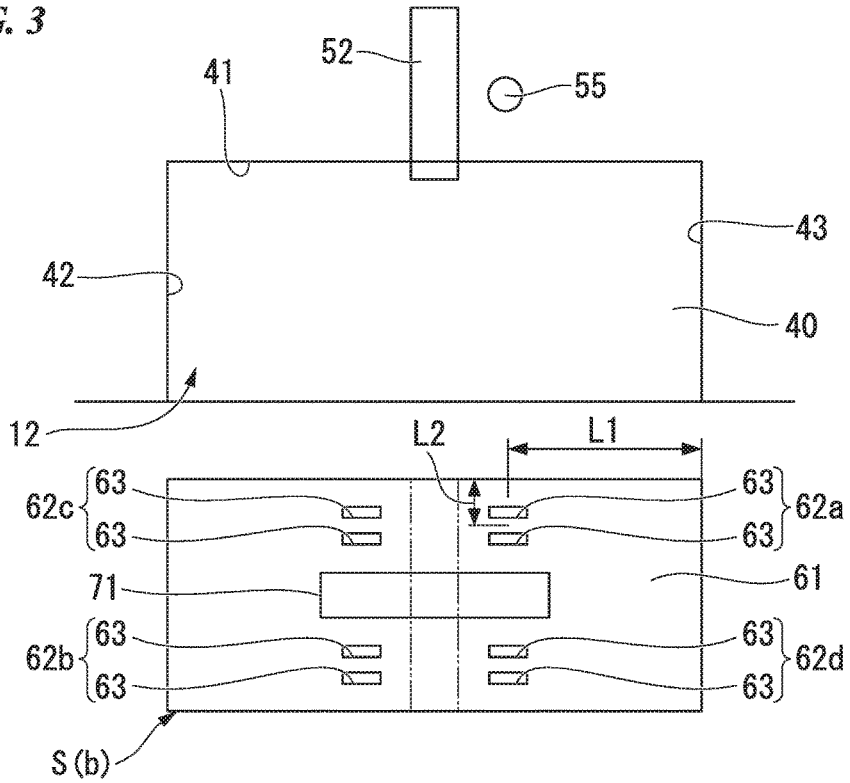
FIG. 3 is a part plan view showing the paper sheet processing device and a partition card according to the embodiment of the present invention.
Figure 4:
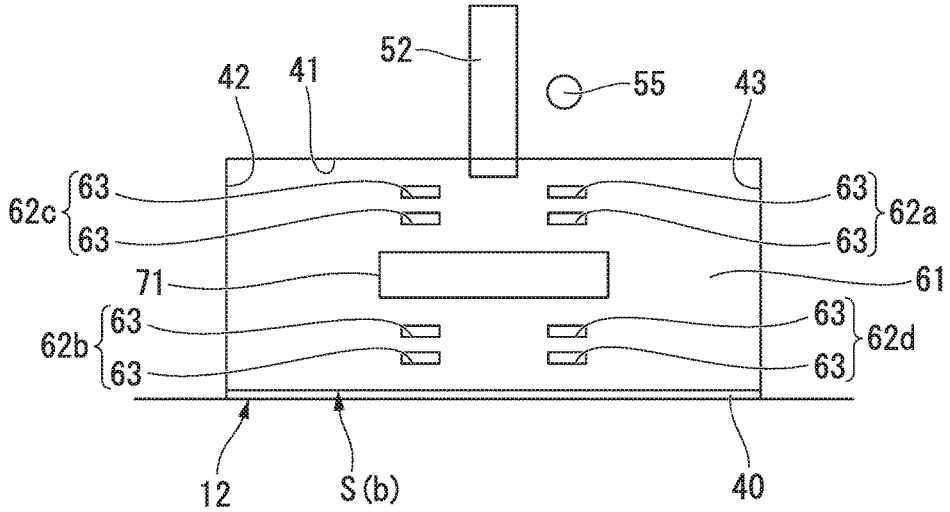
FIG. 4 is a part plan view showing the paper sheet processing device and the partition card according to the embodiment of the present invention, showing an arrangement state of the partition card to a charging inlet.

The charging inlet 12, as described above, is provided on the right-side surface of the paper sheet processing device 11 so as to open to the right side. The charging inlet 12 includes a bottom portion 40, a wall portion 41, a wall portion 42, and a wall portion 43. The bottom portion 40 slopes slightly downward to the left with respect to horizontal. The wall portion 41 extends perpendicularly to the bottom portion 40 from the back side position of the bottom portion 40. The wall portion 42 shown in FIG. 3 extends perpendicularly to the bottom portion 40 from one end edge portion of the bottom portion 40 in the width direction. The wall portion 43 extends perpendicularly to the bottom portion 40 from the other end edge portion of the bottom portion 40 in the width direction. The wall portion 42 and the wall portion 43 are arranged in parallel. The wall portion 41 is arranged perpendicularly to the wall portions 42 and 43. The wall portion 42 is arranged on the front side of the paper sheet processing device 11, and the wall portion 42 is arranged on the rear side of the paper sheet processing device 11. In the charging inlet 12, the paper sheets S are arranged on the bottom portion 40 and between the wall portions 42 and 43 as shown in FIG. 4, and placed so as to abut at least the wall portion 41.

In the charging inlet 12, the rectangular-shaped paper sheets S are set so that the long side follows the wall portion 41, and the short sides follow the wall portions 42 and 43. In other words, the paper sheet S is set in the charging inlet 12 so that the longitudinal direction (long-side direction) thereof matches the direction that joins the wall portions 42 and 43, which is the longitudinal direction (width direction) of the charging inlet 12, and the transverse direction (short-side direction) thereof becomes perpendicular to the wall portion 41.

The charging inlet 12 has a length between the walls 42 and 43 that is nearly the same length as the longest of the bills S (a) to be processed shown in FIG. 2, and slightly longer than the longest length of the bills S (a) to be processed. As shown in FIG. 1, the charging inlet 12 includes a bill press 45 that is provided above the bottom portion 40 and that moves up and down along the wall portion 41. The bill press 45 presses the paper sheets S placed on the bottom portion 40 toward the bottom portion 40.

The charging inlet 12 includes an ejection roller 51, a take-in roller 52, and a separation roller 53. The ejection roller 51 ejects the bottommost paper sheet S among the paper sheets S set on the bottom portion 40 toward the conveying unit 21. The take-in roller 52 that takes into the paper sheet processing device 11 the paper sheet S ejected by the ejection roller 51 and delivers it to the conveying unit 21. The separation roller 53 separates one by one the paper sheets S taken in by the take-in roller 52. The charging inlet 12 takes into the paper sheet processing device 11 the paper sheet group G shown in FIG. 2. The paper sheet group G includes at least one bill S (a) to be processed and the partition card S (b) arranged overlapping the at least one bill S (a) to be processed.

Since the charging inlet 12 is provided on the right-side surface of the abovementioned paper sheet processing device 11 so as to open to the right side, the width direction of the charging inlet 12 matches the fore-aft direction of the paper sheet processing device 11. As shown in FIG. 3, the take-in roller 52 is provided in the approximate central portion of the charging inlet 12 in the width direction of the charging inlet 12. The separation roller 53, shown in FIG. 1, has the circumferential surface that makes contact with the circumferential surface of the take-in roller 52, and is also provided in the approximate central portion of the charging inlet 12 in the width direction of the charging inlet 12.

As shown in FIG. 3, the paper sheet processing device 11 includes a take-in sensor 55 (detection unit) that is disposed at a position near the charging inlet 12. The take-in sensor 55 detects the taking-in of a paper sheet S. The take-in sensor 55 is provided further on the deep side (downstream side) than the charging inlet 12 in the conveying direction perpendicular to the width direction of the charging inlet 12, and provided at a position at which a paper sheet S moving along the conveyance path 25 shown in FIG. 1 passes. As shown in FIG. 3, the take-in sensor 55 is disposed at a position that is displaced by a predetermined distance in the width direction of the charging inlet 12, with respect to the central portion of the charging inlet 12 in the width direction, in order to avoid interference with the take-in roller 52. Specifically, the take-in sensor 55 is disposed in a manner shifted by a predetermined distance to the wall portion 43 side in this width direction from the central portion of the charging inlet 12 in the width direction.

The take-in sensor 55 is a transmission optical sensor that has a light emitting element and a light receiving element disposed so as to allow a paper sheet S taken in from the charging inlet 12 to pass between these elements. The take-in sensor 55 detects that there is no paper sheet S at the position of the take-in sensor 55 when in a light-transmission state in which the light receiving element receives light emitted from the light emitting element. The take-in sensor 55 detects that there is a paper sheet S at the position of the take-in sensor 55 when in a light-shielded state in which the light receiving element does not receive light emitted from the light emitting element. The take-in sensor 55 is provided at a position at which it can detect the partition card S (b) and bills S (a) to be processed of all denominations that are disposed between the wall portions 42 and 43 and are taken in. Therefore, the take-in sensor 55 detects the taking-in of the paper sheet group G from the charging inlet 12.

The partition card S (b) has a rectangular shape, with the length in the longitudinal direction being equivalent to the longest length of the bills S (a) to be processed, and slightly shorter than the length between the wall portions 42 and 43. Thereby, the partition card S (b) has an equivalent length to that of the bills S (a) to be processed, or a slightly longer length than that of the bills S (a). The partition card S (b) is set in the charging inlet 12 so that the long side of the partition card S (b) follows the wall portion 41, and the short sides of the partition card S (b) follow the wall portions 42 and 43. Moreover, the partition card S (b) is set in the charging inlet 12 so as to abut the wall portion 41 and the wall portion 43. The charging inlet 12 conveys the partition card S (b) and the bills S (a) to be processed, which are both paper sheets S, along the transverse direction of each to the wall portion 41, and takes them into the interior of the paper sheet processing device 11. The conveying unit 21 also conveys the partition card S (b) and the bills S (a) to be processed along the transverse direction of each.

The partition card S (b) has a main surface portion 61 having the widest surface area. The main surface portion 61 has four identification hole groups 62*a*, 62*b*, 62*c*, 62*d* that are formed therein. Here, the longitudinal direction of the main surface portion 61 matches the longitudinal direction of the partition card S (b), and the length of the main surface portion 61 in the longitudinal direction matches the length of the partition card S (b) in the longitudinal direction. The transverse direction of the main surface portion 61 matches the transverse direction of the partition card S (b), and the length of the main surface portion 61 in the transverse direction matches the length of the partition card S (b) in the transverse direction.

The identification hole groups 62*a* to 62*d* all have the same shape, and all are constituted by two through holes 63 provided aligned in the transverse direction of the main surface portion 61. Since the partition card S (b) is conveyed so as to move along the transverse direction thereof, the two through holes 63 provided aligned in the transverse direction of the partition card S (b) can also be said to be aligned in the conveyance direction. All of the through holes 63 penetrate the partition card S (b) from the main surface portion 61 to a main surface portion 64 shown in FIG. 6 on the reverse side, and thus the identification hole groups 62*a* to 62*d* are also formed in the main surface portion 64.

As shown in FIG. 3, the eight through holes 63 that constitute all of the identification hole groups 62*a* to 62*d* all have the same rectangular shape, and specifically an long rectangular shape, and the longitudinal direction of all of the through holes 63 matches the longitudinal direction of the main surface portion 61. In addition, the positions of the two through holes 63 that constitute the same identification hole group mutually match in the longitudinal direction of the main surface portion 61. The interval in the transverse direction of the main surface portion 61 between the two through holes 63 that constitute each of the identification hole groups 62*a* to 62*d* is a predetermined uniform interval.

The first identification hole group 62*a* is formed displaced to one side from the central portion in the longitudinal direction of the main surface portion 61 and displaced to one side from the central portion in the transverse direction. The second identification hole group 62*b* is formed displaced to the other side from the central portion in the longitudinal direction of the main surface portion 61 and displaced to the other side from the central portion in the transverse direction. The third identification hole group 62*c* is formed displaced to the other side from the central portion in the longitudinal direction of the main surface portion 61 and displaced to the one side from the central portion in the transverse direction. The fourth identification hole group 62*d* is formed displaced to the one side from the central portion in the longitudinal direction of the main surface portion 61 and displaced to the other side from the central portion in the transverse direction. That is, with respect to the conveyance direction of the main surface portion 61 of the partition card S (b) by the conveying portion 21 (hereinbelow called the conveyance direction), the identification hole groups 62*a* to 62*d* are formed at positions displaced from the central portion of the main surface portion 61 of the partition card S (b) in a first direction orthogonal to the conveyance direction (hereinbelow called the conveyance orthogonal direction). Also, of the identification hole groups 62*a* to 62*d*, the two identification hole groups 62*a* and 62*d* are formed at one side in the conveyance orthogonal direction (longitudinal direction) of the main surface portion 61 of the partition card S (b), while the two identification hole groups 62*b* and 62*c* are formed at the other side in the longitudinal direction.

The identification hole groups 62*a* and 62*c* are arranged side by side in the longitudinal direction of the main surface portion 61, with their positions in the transverse direction matched with each other. The identification hole groups 62*b* and 62*d* are arranged side by side in the longitudinal direction of the main surface portion 61, with their positions in the transverse direction being matched with each other. The identification hole groups 62*a* and 62*d* are arranged side by side in the transverse direction of the main surface portion 61, with their positions in the longitudinal direction being matched with each other. The identification hole groups 62*b* and 62*c* are arranged side by side in the transverse direction of the main surface portion 61, with their positions in the longitudinal direction being matched with each other.

The distance L1 between each of these identification hole groups 62*a* to 62*d* and the closest short side of the main surface portion 61 is the same for all of the identification hole groups 62*a* to 62*d*. The length L2 between each of these identification hole groups 62*a* to 62*d* and the closest long side of the main surface portion 61 is the same for all of the identification hole groups 62*a* to 62*d*.

From the above, the identification hole groups 62*a* and 62*d* (the centers of the identification hole groups 62*a* and 62*d*) are arranged in the main surface portion 61 at positions shifted from their near-side short side (the right-side short side in FIG. 3) toward their far-side short side (the left-side short side in FIG. 3) by the predetermined distance L1. The identification hole groups 62*b* and 62*c* (the centers of the identification hole groups 62*b* and 62*c*) are arranged in the main surface portion 61 at positions shifted from their near-side short side (the left-side short side in FIG. 3) toward their far-side short side (the right-side short side in FIG. 3) by the same predetermined distance L1 as the distance between the identification hole groups 62*a* and 62*d* and their near-side short side.

The identification hole groups 62*a* and 62*c* (the centers of the identification hole groups 62*a* and 62*c*) are arranged in the main surface portion 61 at positions shifted from their near-side long side (the upper-side long side in FIG. 3) toward their far-side long side (the bottom-side long side in FIG. 3) by the predetermined distance L2. The identification hole groups 62*b* and 62*d* (the centers of the identification hole groups 62*b* and 62*d*) are arranged in the main surface portion 61 at positions shifted from their near-side long side (the lower-side long side in FIG. 3) toward their far-side long side (the upper-side long side in FIG. 3) by the same predetermined distance L2 as the distance between the identification hole groups 62*a* and 62*c* and their near-side long side.

The identification hole groups 62*a* and 62*d* at the one side in the longitudinal direction of the main surface portion 61 and the identification hole groups 62*c* and 62*b* at the other side are symmetrical with respect to the central portion in the longitudinal direction of the main surface portion 61. The identification hole groups 62*a* and 62*c* at the one side in the transverse direction and the identification hole groups 62*c* and 62*b* at the other side in the transverse direction of the main surface portion 61 are symmetrical with respect to the central portion in the transverse direction of the main surface portion 61.

The length in the longitudinal direction between the identification hole groups 62*a* to 62*d* and the short side of the main surface portion 61 that is closest to each is the same length as the length in the width direction of the charging inlet 12 between the take-in sensor 55 and the wall portion 43. The wall portion 43 is the end portion in the width direction of the charging inlet 12 on the side near the take-in sensor 55. The length in this conveyance orthogonal direction between: the identification hole groups 62*a* and 62*d* at the one side in the conveyance orthogonal direction; and the end of the main surface portion 61 on the side near the identification hole groups 62*a* and 62*d* in this conveyance orthogonal direction, is the same length as the length in the width direction between the take-in sensor 55 and the wall portion 43, which is the end of the charging inlet 12 on the side near the take-in sensor 55 in the width direction. The conveyance orthogonal direction is the longitudinal direction of the main surface portion 61. Similarly, the length in this conveyance orthogonal direction between: the identification hole groups 62*b* and 62*c* at the other side in the conveyance orthogonal direction; and the end of the main surface portion 61 on the side near the identification hole groups 62*b* and 62*c* in this conveyance orthogonal direction, is the same length as the length in the width direction between the take-in sensor 55 and the wall portion 43, which is the end in the width direction of the charging inlet 12 on the side near the take-in sensor 55.

With the above configuration, when the partition card S (b) is taken in from the charging inlet 12, the take-in sensor 55 enters the light-shielded state by the portion other than the identification hole groups 62*a* to 62*d* of the partition card S (b), and enters the light-transmission state by the two through holes 63 at two respective locations whose positions in the longitudinal direction of the partition card S (b) match the take-in sensor 55, among the identification hole groups 62*a* to 62*d*. That is, the take-in sensor 55 detects the presence of the paper sheet S that constitutes the paper sheet group G and the presence of the identification hole groups 62*a* to 62*d* in the paper sheet S by light transmission and light shielding.

Here, in the case of the paper sheet S being taken in from the state of being set between the wall portions 42 and 43 of the charging inlet 12, the control unit 32 identifies whether the paper sheet S is a partition card S (b) or a bill S (a) to be processed by whether the take-in sensor 55 has detected one of the identification hole groups 62*a* to 62*d* by light transmission within a predetermined monitoring time after the start of detection of the paper sheet S by the light shielding. Here, the abovementioned monitoring time is a value obtained by dividing a predetermined distance by the take-in conveyance speed of the charging inlet 12. The predetermined distance may be longer than the maximum distance between the long side of the partition card S (b) on the side near the identification hole group 62*a* and the through hole 63 of the identification hole group 62*a* on the far side from this long side, and shorter than the minimum distance between this long side and the through hole 63 of the identification hole group 62*d* on the side near this long side.

For example, FIG. 4 shows a case where the partition card S (b) is arranged in the charging inlet 12 with the main surface portion 61 facing upward in the vertical direction and the identification hole groups 62*a* and 62*c* being oriented closer to the wall portion 41 than the identification hole groups 62*b* and 62*d*. In this case, the take-in sensor 55, after the start of detection of this partition card S (b) by the light shielding, detects the identification hole group 62*a* near the wall portion 41 and near the wall portion 43 by the two light transmissions that occur within the monitoring time.

Figure 5:
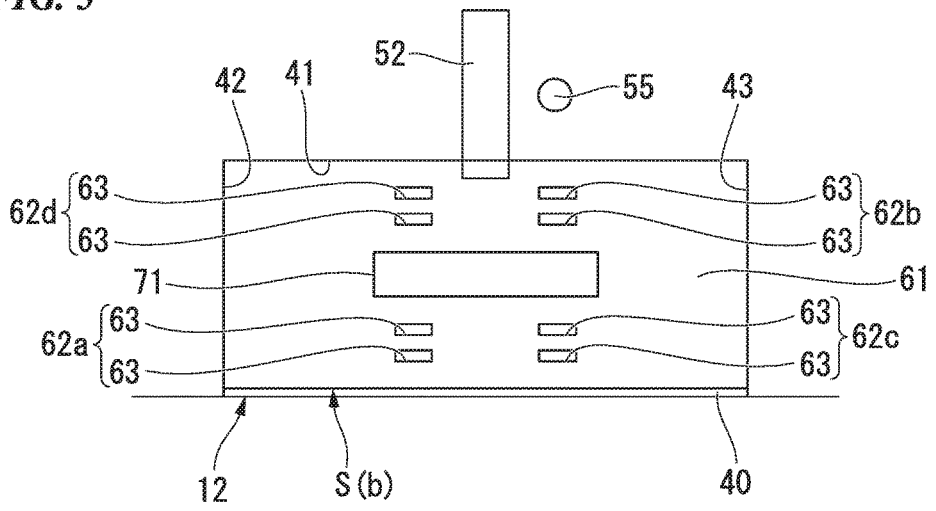
FIG. 5 is a part plan view showing the paper sheet processing device and the partition card according to the embodiment of the present invention, showing another arrangement state of the partition card to the charging inlet.

FIG. 5 shows a case where the partition card S (b) is arranged in the charging inlet 12 with the main surface portion 61 facing upward in the vertical direction and the identification hole groups 62*b* and 62*d* being oriented closer to the wall portion 41 than the identification hole groups 62*a* and 62*c*. In this case, the take-in sensor 55, after the start of detection of this partition card S (b) by the light shielding, detects the identification hole group 62*b* near the wall portion 41 and near the wall portion 43 by the two light transmissions that occur within the monitoring time.

Figure 6:
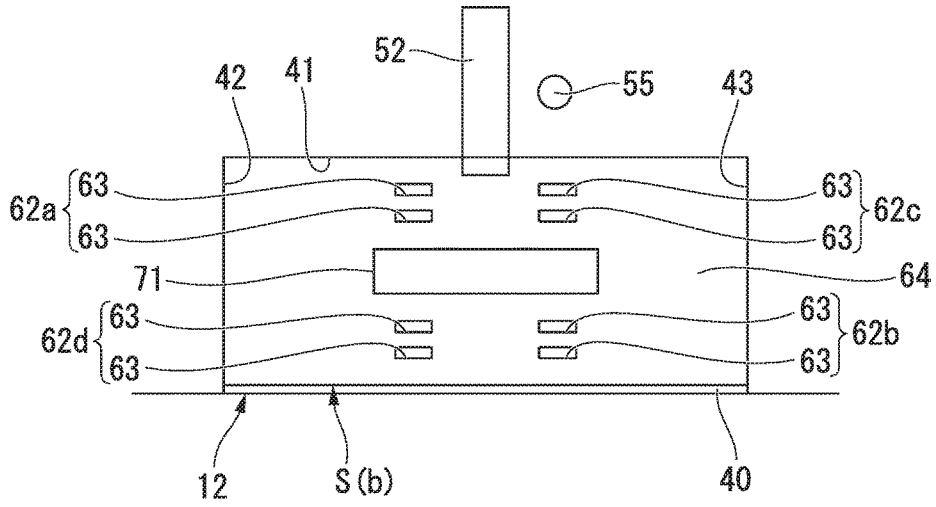
FIG. 6 is a part plan view showing the paper sheet processing device and the partition card according to the embodiment of the present invention, showing yet another arrangement state of the partition card to the charging inlet.

FIG. 6 shows a case where the partition card S (b) is arranged in the charging inlet 12 with the main surface portion 64 facing upward in the vertical direction and the identification hole groups 62*a* and 62*c* being oriented closer to the wall portion 41 than the identification hole groups 62*b* and 62*d*. In this case, the take-in sensor 55, after the start of detection of this partition card S (b) by the light shielding, detects the identification hole group 62*c* near the wall portion 41 and near the wall portion 43 by the two light transmissions that occur within the monitoring time.

Figure 7:
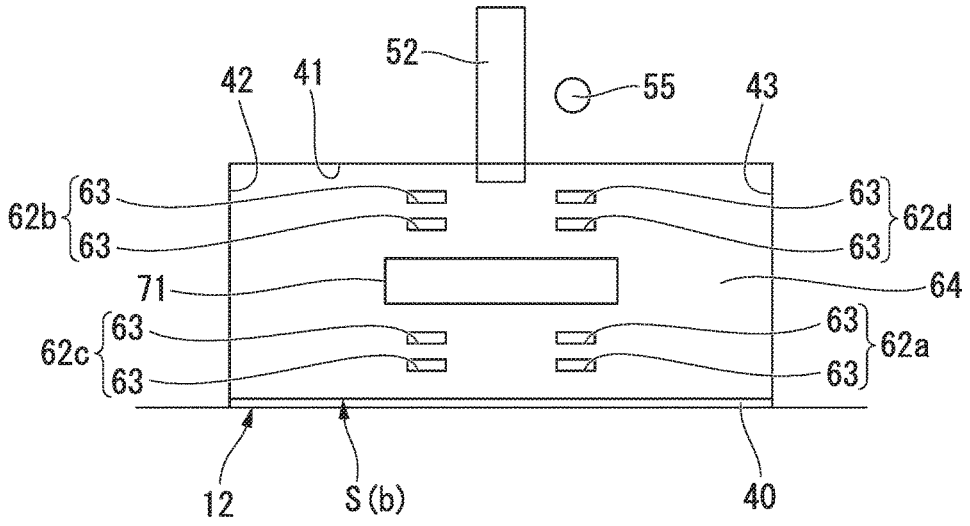
FIG. 7 is a part plan view showing the paper sheet processing device and the partition card according to the embodiment of the present invention, showing still yet another arrangement state of the partition card to the charging inlet.

FIG. 7 shows a case where the partition card S (b) is arranged in the charging inlet 12 with the main surface portion 64 facing upward in the vertical direction and the identification hole groups 62*b* and 62*d* being oriented closer to the wall portion 41 than the identification hole groups 62*a* and 62*c*. In this case, the take-in sensor 55, after the start of detection of this partition card S (b) by the light shielding, detects the identification hole group 62*d* near the wall portion 41 and near the wall portion 43 by the two light transmissions that occur within the monitoring time.

When the detection state of the take-in sensor 55 changes from the light-transmission state to the light-shielded state in a time interval that is equal to or more than a predetermined time corresponding to the shortest take-in interval between the paper sheets 5, the control unit 32 detects the start of take-in of a paper sheet S. When a state change having the pattern of light transmission, light shielding, light transmission, and light shielding occurs within the observation time after this paper sheet S take-in start detection, the control unit 32 identifies this paper sheet S as a partition card S (b). When the state change having the pattern of light transmission, light shielding, light transmission, and light shielding does not occur within the observation time after the paper sheet S take-in start detection, the control unit 32 identifies this paper sheet S as a bill S (a) to be processed. That is, the control unit 32 determines that a paper sheet S whose take-in from the charging inlet 12 has been detected by the take-in sensor 55 and in which one of the identification hole groups 62*a* to 62*d* has been detected by the take-in sensor 55 is the partition card S (b). By contrast, the control unit 32 determines that a paper sheet S whose take-in from the charging inlet 12 has been detected by the take-in sensor 55 and in which any one of the identification hole groups 62*a* to 62*d* has not been detected by the take-in sensor 55 is a bill S (a) to be processed.

The control unit 32 sorts the plurality of paper sheet groups G set in the charging inlet 12 one by one, and distributes each section B (a) into any one of the plurality of accumulation units 14. Also, the control unit 32 classifies each paper sheet group G into partition cards S (b) and bills S (a) to be processed, conveying the partition cards S (b) to the reject unit 13 and the bill S (a) to be processed to the respective accumulation units 14.

As shown in FIG. 3, the main surface portion 61 has an identification display portion 71 printed thereon. The identification display portion 71 is provided at the central position of the main surface portion 61, in the transverse direction between the identification hole groups 62*a* and 62*c* and the identification hole groups 62*b* and 62*d*. The identification display portion 71 may be used for distinguishing the partition card S (b) from others, and may be a barcode that shows identification information such as numerical values and characters. In other words, since the identification display portion 71 is formed in the central portion of the main surface portion 61 in the transverse direction, the identification hole groups 62*a* to 62*d* are formed at positions shifted from the central portion in the transverse direction of the main surface portion 61. Here, the identification hole groups 62*a* to 62*d* are arranged so that their positions overlap with the identification display portion 71 in the longitudinal direction of the main surface portion 61. In one partition card S (b), the same thing as the identification display portion 71 printed on the main surface portion 61 is also printed on the main surface portion 64 shown in FIG.

6, at the central position in the transverse direction between the identification hole groups 62*a* and 62*c* and the identification hole groups 62*b* and 62*d*. That is, one partition card S (b) has the same identification display portions 71 on both main surface portions 61 and 64.

As shown in FIG. 3, in the partition card S (b), the portion between the identification hole groups 62*a* and 62*d* and the identification hole groups 62*b* and 62*c* makes contact with the take-in roller 52 and the separation roller 53 while passing between them (the two-dot chain lines in FIG. 3 show the passage range of the take-in roller 52 and the separation roller 53). In other words, the identification hole groups 62*b* to 62*d* are formed at positions shifted from the central portion of the main surface portions 61 and 64 in the longitudinal direction because the take-in roller 52 and the separation roller 53 pass the central portion of the main surface portions 61 and 64 in the longitudinal direction.

In the paper sheet processing device 11 according to the present embodiment, one paper sheet group G includes a partition card S (b) and a section B (a). The partition card S (b) is arranged at only the position just before the front side of the section B (a) in the accumulation direction (the lower side in the set state in the charging inlet 12), which is one of both outer sides of each section B (a) in accumulation direction (thickness direction) thereof, and is used for identifying the section B (a) positioned immediately afterward. That is, each partition card S (b) is used as a start card for identifying each start end of each section B (a). An embodiment is not limited thereto, and the partition card S (b) may serve as an end card for identifying the finish end of the section B (a) positioned immediately before and arranged at only the position just after the back side of each section B (a) in the accumulation direction (the upper side in the set state in the charging inlet 12). Alternatively, two partition cards S (b) may be serves as a start card and an end card for identifying the start end and finish end of the section B (a) and arranged at both front and rear sides of the section B (a) in the accumulation direction.

In the paper sheet processing device 11, to proceed the process of identifying each section B (a), according to an operation input to the operation display unit 31 by the operator, a setting process is performed in which the control unit 32 stores in the storage unit 33 the one-to-one correspondence relation between each section 13 (*a*) and the identification display portion 71 of the partition card S (b). Then, the operator sets the partition card S (b) having the identification display portion 71 and the corresponding section B (a) in the charging inlet 12 in a state where the partition card S (b) is arranged on the front side of the corresponding section 13 (*a*) in the direction of accumulation by the charging inlet 12. When a plurality of the sections B (a) are processed at one time, the partition cards S (b) with a one-to-one correspondence are arranged on the front side of each of the plurality of sections B (a) in the accumulation direction by the charging inlet 12, and set in the charging inlet 12.

When the operation instruction input for the start of processing is inputted to the operation display unit 31, the control unit 32 drives the ejection roller 51 and the take-in roller 52 of the charging inlet 12 in the direction of taking in the paper sheets S in the charging inlet 12 and paying them out toward the conveying unit 21, and drives the conveying unit 21. Upon doing so, the lowest paper sheet S is ejected by the ejection roller 51 toward the take-in roller 52. The paper sheets S are separated one at a time by the take-in roller 52 and the separation roller 53, taken in to the conveying unit 21, and conveyed by the conveying unit 21. The paper sheets S taken in by the charging inlet 12 are first detected by the take-in sensor 55 prior to being delivered to the conveying unit 21. Then, the control unit 32 identifies a paper sheet S as the partition card S (b) in a case where the take-in sensor 55 has detected take-in of the paper sheet S from the charging inlet 12 by detection of light shielding and it has detected one of the identification hole groups 62*a* to 62*d* by detection of two light transmissions within the monitoring time after this take-in detection start.

The control unit 32 identifies a paper sheet S as the bill S (a) to be processed in a case where the take-in sensor 55 has detected take-in of the paper sheet S from the charging inlet 12 by detection of light shielding and it has not detected any of the identification hole groups 62*a* to 62*d* because the two light transmissions have not occurred within the monitoring time after this take-in detection start.

Hereinbelow, a description will be given for distinguishing two different partition cards S (b) as a first partition card S (b) and a second partition card S (b), and similarly distinguishing other constitutions as well.

In the charging inlet 12, a second paper sheet group G that is constituted by a second partition card S (b) and a second section 13 (*a*) is arranged overlapping a first paper sheet group G that is constituted by a first partition card S (b) and a first section B (a). The first partition card S (b) and the second partition card S (b) are arranged abutting the wall portion 41 and the wall portion 43 of the charging inlet 12. When the first and second paper sheet groups S are conveyed by the conveying unit 21, the first identification display portion 71 of the first partition card S (b) is read out by the identification unit 22. After being read by the identification unit 22, the control unit 32 conveys the first partition card S (b) by the conveying unit 21 and the sorting units 26 to the reject unit 13.

Then, the bills S (a) to be processed that are conveyed following this first partition card S (b) are identified by the identification unit 22 as bills S (a) to be processed constituting the first section B (a) corresponding to the first identification information expressed by the first identification display portion 71 of the first partition card S (b) and counted. Among the bills S (a) to be processed constituting the first section B (a), the control unit 32 causes authentic bills S (a) to be processed that have been identified as authentic bills from the identification result of the identification unit 22 to be accumulated in a first accumulation unit 14 corresponding to this first section B (a) by the conveying unit 21 and the sorting units 26, and conveys the reject bills S (a) to be processed that have been identified as other than authentic bills to the reject unit 13 by the conveying unit 21 and the sorting units 26.

When the take-in sensor 55 detects the second partition card S (b) following the first partition card S (b), the control unit 32 stops the ejection roller 51 and the take-in roller 52, and suspends the taking-in of paper sheets constituting the paper sheet group G by the charging inlet 12. At this time, the second partition card S (b), which is a paper sheet S, stops between the take-in roller 52 and the separation roller 53. The control unit 32 continues identification by the identification unit 22 of the bills S (a) to be processed constituting the first section B (a), conveyance to the first accumulation unit 14 of the authentic bills S (a) to be processed, and conveyance to the reject unit 13 of the reject bills S (a) to be processed without stopping the conveying unit 21 during the take-in suspension.

Upon determining that all of the bills S (a) to be processed constituting the first section B (a) have been conveyed to either the first accumulation unit 14 or the reject unit 13, and that there no more bills S (a) to be processed on the conveying unit 21, the control unit 32 determines that the processing of the first paper sheet group G including the first partition card S (b) and the first section B (a) is finished. Then, the control unit 32 again drives the ejection roller 51 and the take-in roller 52 to deliver to the conveying unit 21 the second partition card S (b) of the second paper sheet group G, which was stopped for a while. Then, the second partition card S (b) is conveyed by the conveying unit 21, and the second identification display portion 71 thereof is read by the identification unit 22. The control unit 32 causes the second partition card S (b), after being read by the identification unit 22, to be conveyed to the reject unit 13 by the conveying unit 21 and the sorting units 26.

Then, the bills S (a) to be processed that are conveyed following this second partition card S (b) are identified by the identification unit 22 as bills S (a) to be processed constituting the second section B (a) corresponding to the second identification information expressed by the second identification display portion 71 of the second partition card S (b) and counted. Among the bills S (a) to be processed constituting the second section B (a), the control unit 32 causes the authentic bills S (a) to be processed that have been identified as authentic bills from the identification result of the identification unit 22 to be accumulated in the second accumulation unit 14 corresponding to this second section B (a) by the conveying unit 21 and the sorting units 26, and conveys the reject bills S (a) to be processed that have been identified as other than authentic bills to the reject unit 13 by the conveying unit 21 and the sorting units 26.

In this way, the control unit 32 classifies the first paper sheet group G that includes the first partition card S (b) and the second paper sheet group G that includes the second partition card S (b).

By appropriately repeating the above process, when the control unit 32 detects the absence of paper sheets S in the charging inlet 12 by the light-transmission state of the take-in sensor 55 continuing for a predetermined time, the control unit 32 displays in the operation display unit 31, in association with the identification of each accumulation unit 14, for example the total monetary value on the basis of the identification of the authentic bills S (a) to be processed of the section B (a) accumulated in each accumulation unit 14 and the aggregated total of counting.

According to the abovementioned paper sheet processing device 11, when the charging inlet 12 takes in the paper sheet group G having at least one bill S (a) to be processed and a partition card S (b), the take-in sensor 55 detects the take-in of the paper sheet group G from the charging inlet 12 and also detects one of the identification hole groups 62*a* to 62*d* each constituted by at least two through holes 63 provided in the main surface portions 61 and 64 of the partition card S (b) and arranged along the conveying direction. The control unit 32 determines that the paper sheet S whose take-in was detected by the take-in sensor 55 and in which the take-in sensor 55 has detected one of the identification hole groups 62*a* to 62*d* is the partition card S (b). The control unit 32 determines that the paper sheet S whose take-in was detected by the take-in sensor 55 and in which the take-in sensor 55 has detected none of the identification hole groups 62*a* to 62*d* is the bill S (a) to be processed. In this manner, the control unit 32 classifies the paper sheet groups G. Since the take-in sensor 55 is only required to detect the presence of one of the identification hole groups 62*a* to 62*d* constituted by at least two through holes 63 provided in the main surface portions 61 and 64 of the partition card S (b) and arranged along the conveying direction, there is an advantage in that a reduction in the cost of the constitution for identifying the partition card S (b) and the bill S (a) to be processed can be achieved. Accordingly, it is possible to inhibit a cost increase. Moreover, it is possible to simplify and downsize the constitution for identifying the partition card S (b) and the bill S (a) to be processed.

Also, according to the paper sheet processing device 11, the identification hole groups 62*a* and 62*d* are formed at positions displaced from the central portion of the main surface portions 61 and 64 of the partition card S (b) in a conveyance orthogonal direction orthogonal to the conveyance direction thereof. The take-in sensor 55 is arranged at a position displaced in the width direction of the charging inlet 12 with respect to the central portion in this width direction. The length in the conveyance orthogonal direction between the identification hole groups 62*a* and 62*d* and the end of the main surface portions 61 and 64 of the partition card S (b) at the side near the identification hole groups 62*a* and 62*d* is the same length as the length in the width direction of the charging inlet 12 between the take-in sensor 55 and the end of the charging inlet 12 at the side near the identification hole groups 62*a* and 62*d* in the width direction of the charging inlet 12. The length in the conveyance orthogonal direction between the identification hole groups 62*b* and 62*c* and the end of the main surface portions 61 and 64 of the partition card S (b) at the side near the identification hole groups 62*b* and 62*c* in the conveyance orthogonal direction is the same length as the length in the width direction of the charging inlet 12 between the take-in sensor 55 and the end of the charging inlet 12 at the side near the identification hole groups 62*b* and 62*c* in the width direction of the charging inlet 12. Accordingly, it is possible to favorably detect one of the identification hole groups 62*a* to 62*d* by the take-in sensor 55.

Also, according to the paper sheet processing device 11, the two identification hole groups 62*a* and 62*d* are formed at one side of the partition card S (b) in the conveyance orthogonal direction and the two identification hole groups 62*b* and 62*c* are formed at the other side of the partition card S (b) in the conveyance orthogonal direction. The length in the conveyance orthogonal direction between the identification hole groups 62*a* and 62*d* at the one side in the conveyance orthogonal direction and the one end of the main surface portions 61 and 64 of the partition card S (b) at the side near the identification hole groups 62*a* and 62*d* in the conveyance orthogonal direction, and the length in the conveyance orthogonal direction between the identification hole groups 62*b* and 62*c* at the other side in the conveyance orthogonal direction and the other end of the main surface portions 61 and 64 of the partition card S (b) at the side near the identification hole groups 62*b* and 62*c* in the conveyance orthogonal direction are the same length as the length in the width direction of the charging inlet 12 between the take-in sensor 55 and the end of the charging inlet 12 in this width direction. Accordingly, it is possible to detect one of the identification hole groups 62*a* to 62*d* by the take-in sensor 55 regardless of the orientation (front/back and top/bottom) of the charging of the partition card S (b). Therefore, there is no need to arrange the orientation of the partition card S (b) for charging, and so workability is good.

Also, according to the paper sheet processing device 11, when the control unit 32 determines that a paper sheet S is the partition sheet S (b) by its taking-in and one of the identification hole groups 62*a* to 62*d* being detected by the take-in sensor 55, the control unit 32 suspends the taking-in of the paper sheet group G on the basis of this determination. Therefore, it is possible to create a take-in interval between bills S (a) to be processed before and after the partition card S (b), that is, between bills S (a) to be processed with different classifications. Thereby, during a paper jam or the like, it is possible to favorably and easily separate the bills S (a) to be processed with different classifications. Moreover, since the pick-up sensor 55 is disposed near the charging inlet 12, when a paper sheet S is determined to be the partition card S (b) and the take-in of the paper sheet group G is suspended, it is possible to have the paper sheets S on the downstream side of the partition card S (b) remain in the charging inlet 12. Thereby, it is possible to inhibit mixing together of the bills S (a) to be processed of different classifications within the paper sheet processing device 11.

That is, when classifying each paper sheet group G by identifying the partition card S (b) and the bills S (a) to be processed thereof with the identification unit 22 built into the paper sheet processing device 11, in the event of for example a stoppage of the paper sheet processing device 11 due to a paper jam or the like, even if control is performed so as to suspend the taking-in of the bills S (a) to be processed of the next section B (a) until the processing of the prior section B (a) finishes so that bills S (a) to be processed of different sections B (a) are not mixed together, since they are identified as the partition card S (b) or the bills S (a) to be processed by the identification unit 22, some bills S (a) to be processed of the next section B (a) may in reality end up being present on the conveyance path 25 between the charging inlet 12 and the identification unit 22. Thereby, there is a risk of bills S (a) to be processed of a plurality of different sections B (a) being mixed together. In contrast, since it is possible to classify each paper sheet group G by identifying the partition card S (b) and the bills S (a) to be processed in the vicinity of the charging inlet 12, it is possible to prevent the mixing together of the bills S (a) to be processed of different sections B (a) within the paper sheet processing device 11 (within the conveying unit 21).

Also, if a take-in sensor for detecting the take-in of paper sheets of the charging inlet is provided in a conventional paper sheet processing device, it is possible to achieve the abovementioned paper sheet processing device 11 just by a software upgrade and creation of the partition card S (b) without changing the hardware constitution.

When the abovementioned partition card S (b) is disposed in the paper sheet processing device 11 overlapping at least one bill S (a) to be processed and taken in from the charging inlet 12, it causes the paper sheet processing device 11 to classify the paper sheet group G by having the take-in sensor 55 detect one of the identification hole groups 62*a* to 62*d* constituted by at least two through holes 63 provided in alignment in the conveyance direction. In this way, since the take-in sensor 55 is made to detect the presence of one of the identification hole groups 62*a* to 62*d* constituted by at least two through holes 63 provided in alignment in the conveyance direction, there is a reduction in the cost of the constitution for identifying the bills S (a) to be processed. Accordingly, it is possible to hold down a cost increase of the paper sheet processing device 11. Moreover, it is possible to achieve a simplification and downsizing of the constitution for identifying the bills S (a) to be processed.

In addition, according to the partition card S (b), the identification hole groups 62*a* and 62*d* are formed at a position displaced in the conveyance orthogonal direction, which is orthogonal to the conveyance direction, from the central portion in the conveyance orthogonal direction. The identification hole groups 62*b* and 62*c* are formed at a position displaced in the conveyance orthogonal direction from the central portion in the conveyance orthogonal direction. The take-in sensor 55 is disposed at a position displaced in the width direction of the charging inlet 12 with respect to the central portion in the width direction. The length in the conveyance orthogonal direction between the identification hole groups 62*a* and 62*d* and the end of the main surface portions 61 and 64 at the side near the identification hole groups 62*a* and 62*d* in the conveyance orthogonal direction, and the length in the conveyance orthogonal direction between the identification hole groups 62*b* and 62*c* and the end of the main surface portions 61 and 64 at the side near the identification hole groups 62*b* and 62*c* in the conveyance orthogonal direction are the same length as the length in the width direction of the charging inlet 12 between the take-in sensor 55 and the end of the charging inlet 12 at the side near the take-in sensor 55 in the width direction. Therefore, it is possible to have the detection sensor 55 favorably detect one of the identification hole groups 62*a* to 62*d*.

In addition, according to the partition card S (b), the two identification hole groups 62*a* and 62*d* are formed at one side in the conveyance orthogonal direction and the two identification hole groups 62*b* and 62*c* are formed at the other side in the conveyance orthogonal direction, and the length in the conveyance orthogonal direction between the identification hole groups 62*a* and 62*d* at the one side in the conveyance orthogonal direction and the one end of the main surface portions 61 and 64 at the side near the identification hole groups 62*a* and 62*d* in the conveyance orthogonal direction, and the length in the conveyance orthogonal direction between the identification hole groups 62*b* and 62*c* at the other side in the conveyance orthogonal direction and the other end of the main surface portions 61 and 64 at the side near the identification hole groups 62*b* and 62*c* in the conveyance orthogonal direction are the same length as the length in the width direction of the charging inlet 12 between the take-in sensor 55 and the end of the charging inlet 12 at the side near the take-in sensor 55 in this width direction. Therefore, it is possible to have the take-in sensor 55 detect one of the identification hole groups 62*a* to 62*d* regardless of the charging orientation (front/back and top/bottom). Therefore, there is no need to arrange the charging orientation, and so the workability is good.

The embodiment stated above may be modified as follows.

The partition card S (b) may be set at both the front and rear of the section B (a) in one paper sheet group G. In this case, as the first paper sheet group G a primary first partition card S (b), a first section B (a), and a secondary first partition card S (b) are stacked in this order, and next as a second paper sheet group G a primary second partition card S (b), a second section B (a), and a secondary second partition card S (b) are stacked in this order, with this being performed in accordance with the number of paper sheet groups G. After detection of the primary first partition card S (b), the first section B (a) is detected, and afterward the secondary first partition card S (b) is detected by the take-in sensor 55. Then, the control unit 32 suspends take-in by the charging inlet 12 prior to the ejection roller 51 ejecting the paper sheet S immediately after the secondary first partition card S (b), and conveys the primary first partition card S (b), the first section B (a), and the secondary first partition card S (b) to the corresponding accumulation unit 14 and the reject unit 13. Then, the control unit 32 restarts the take-in of the charging inlet 12, and after detection of the primary second partition card S (b), the second section B (a) is detected. When the secondary second partition card S (b) is subsequently detected by the take-in sensor 55, the control unit 32 suspends take-in by the charging inlet 12 prior to the ejection roller 51 ejecting the paper sheet S immediately after the secondary second partition card S (b). The aforementioned control is repeated appropriately.

In one paper sheet group U, the partition card S (b) may be set only after the section B (a). In this case, as the first paper sheet group G a first section B (a) and a first partition card S (b) are stacked in this order, and next as a second paper sheet group G a second section B (a) and a second partition card S (b) are stacked in this order, with this being performed in accordance with the number of paper sheet groups G. When the first section B (a) is detected and subsequently the first partition card S (b) is detected by the take-in sensor 55, the control unit 32 suspends take-in by the charging inlet 12 prior to the ejection roller 51 ejecting the paper sheet S immediately after the first partition card S (b) and conveys the first section B (a) and the first partition card S (b) to the corresponding accumulation unit 14 and the reject unit 13. Then, the control unit 32 restarts the take-in of the charging inlet 12. After detection of the second section B (a) the second partition card S (b) is detected by the take-in sensor 55. Then, the control unit 32 suspends take-in by the charging inlet 12 prior to the ejection roller 51 ejecting the paper sheet S immediately after the second partition card S (b). The aforementioned control is repeated appropriately.

The identification hole groups 62*a* to 62*d* may each also be constituted by three or more through holes 63. That is, each of the identification hole groups 62*a* to 62*d* may be constituted by at least two of the through holes 63. By constituting each of the identification hole groups 62*a* to 62*d* with three or more through holes 63, it is possible to more reliably identify the partition card S (b) and the bills S (a) to be processed.

It is preferable that the through holes 63 that constitute each of the identification hole groups 62*a* to 62*d* be formed in a rectangular shape for absorbing positional variations with the take-in sensor 55 in the longitudinal direction of the partition card S (b). However, provided detection is possible by the take-in sensor 55, the through holes 63 may be formed in any shape such as a circular shape, square shape, or another polygonal shape.

It is preferable that the four identification hole groups 62*a* to 62*d* be formed in the main surface portions 61 and 64 of the partition card S (b). However, provided detection is possible by the take-in sensor 55, at least one of the identification hole groups 62*a* to 62*d* may be formed.

Figure 8:
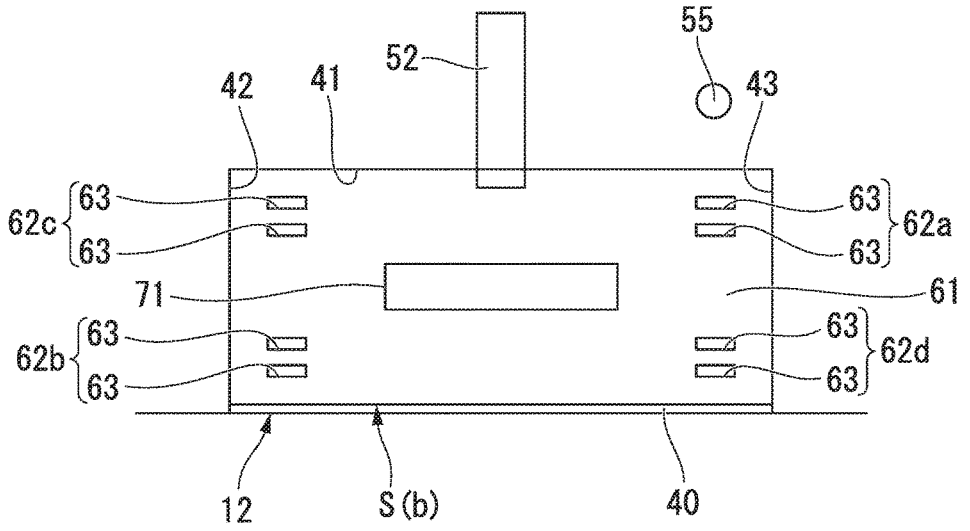
FIG. 8 is a part plan view showing a modification of the paper sheet processing device and the partition card according to the embodiment of the present invention.
Figure 9:
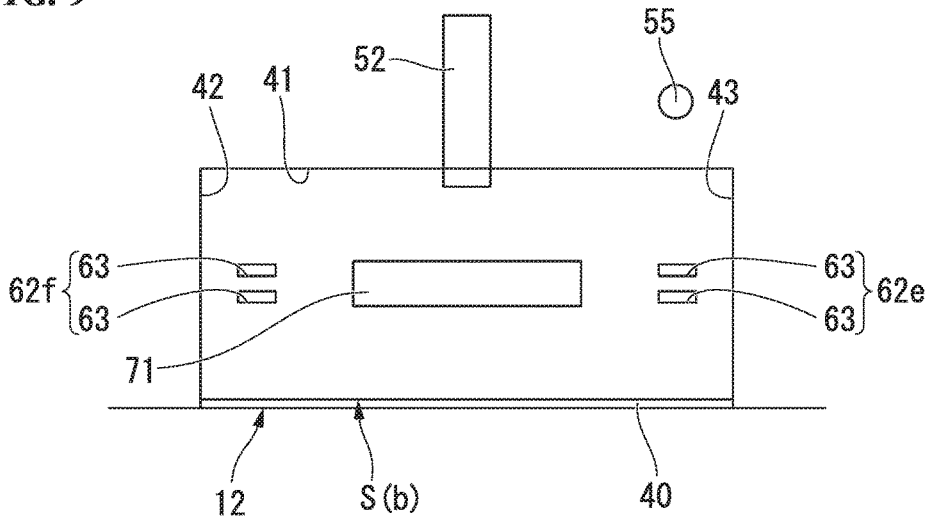
FIG. 9 is a part plan view showing another modification of the paper sheet processing device and the partition card according to the embodiment of the present invention.

The identification hole groups 62*a* to 62*d* are arranged so that the positions thereof overlap with the identification display portion 71 in the longitudinal direction of the partition card S (b) as shown in FIGS. 3 to 7. However, the arrangement is not limited thereto, and as shown in FIG. 8, the identification hole groups 62*a* to 62*d* may be arranged so that the positions thereof do not overlap with the identification display portion 71 in the longitudinal direction of the partition card S(b) in accordance with the position of the take-in sensor 55. In this case, as shown in FIG. 9, two identification hole groups 62*e* and 62*f* may be formed in the central portion of the main surface portion 61 of the partition card S (b) in the transverse direction. In this case, it is acceptable for at least one identification hole group to be formed.

Figure 10:
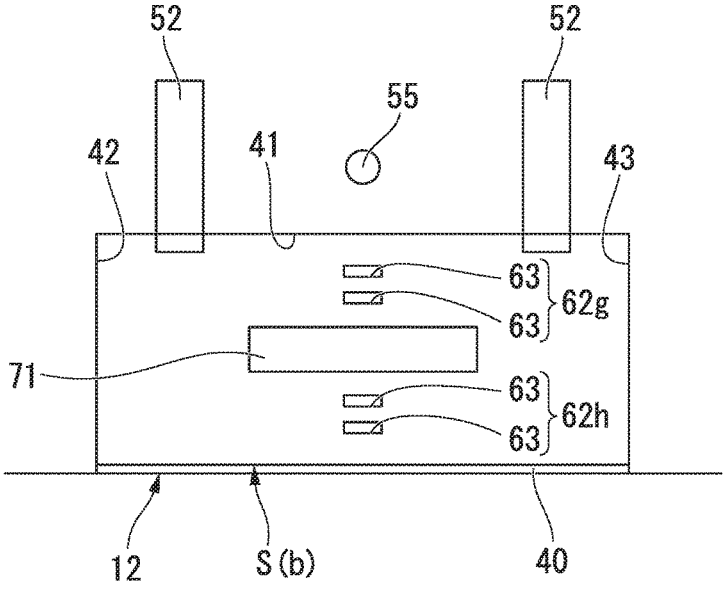
FIG. 10 is a part plan view showing yet another modification of the paper sheet processing device and the partition card according to the embodiment of the present invention.

A configuration shown in FIG. 10 may be employed. That is, the two take-in rollers 52 may be provided at positions shifted in the width direction of the charging inlet 12 from the central portion in this direction. The take-in sensor 55 may be arranged with its position in the width direction of the charging inlet 12 aligned with the central portion of the charging inlet 12 in this width direction. Two identification hole groups 62*g* and 62*h* may be formed in the central portion of the main surface portion 61 of the partition card S (b) in the longitudinal direction. That is, the two identification hole groups 62*g* and 62*h* may be formed in the central portion of the main surface portion 61 of the partition card S (b) in the conveyance orthogonal direction. Thereby, it is possible to detect the identification hole groups 62*g* and 62*h* by the take-in sensor 55 regardless of the charging orientation of the partition card S (b). Therefore, since there is no need to arrange the charging orientation (front/back and top/bottom) of the partition card S (b), the workability is good. In this case as well, it is acceptable for at least one identification hole group to be formed. That is, only one identification hole group may be formed more to the leading side in the conveying direction than the central portion in the transverse direction of the main surface portion 61. Only one identification hole group may be formed more to the trailing side in the conveying direction than the central portion in the transverse direction of the main surface portion 61. An identification hole group may be formed more to the conveying direction leading side and the conveying direction trailing side than the central portion in the transverse direction of the main surface portion 61.

It is preferable that, in the case of a partition card S (b) being detected by the take-in sensor 55, the control unit 32 suspends take-in of the paper sheets S on the basis of this, but it may not perform such a suspension.

Figure 11:
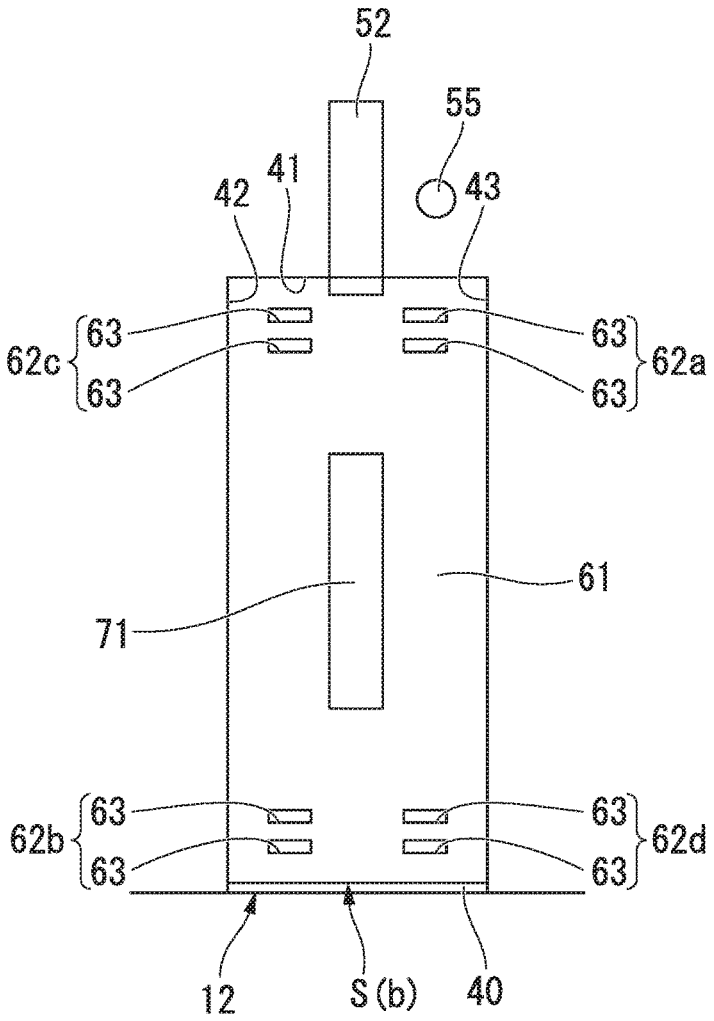
FIG. 11 is a part plan view showing still yet another modification of the paper sheet processing device and the partition card according to the embodiment of the present invention.

The partition card S (b) is not limited to its transverse direction serving as the conveying direction as described above, and so its longitudinal direction may also serve as the conveying direction. In this case, as shown in FIG. 11, each of the identification hole groups 62*a* to 62*d* is constituted by through holes 63 being disposed at a predetermined interval in the longitudinal direction (conveyance direction) of the partition card S (b). In this case as well, it is possible to appropriately adopt the abovementioned modifications.

Figure 12:
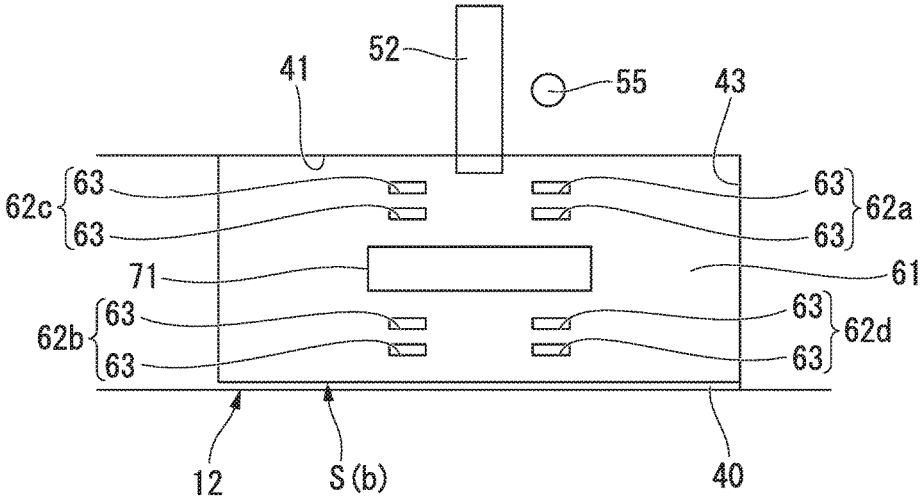
FIG. 12 is a part plan view showing a modification of the charging inlet of the paper sheet processing device according to the embodiment of the present invention.

The charging inlet 12 is not limited to being provided on the right-side surface of the paper sheet processing device 11 so as to open to the right side as shown in FIG. 4 and the like, and may also be provided on the right-side surface of the paper sheet processing device 11 so as to open to the right side and the front as shown in FIG. 12. That is, the charging inlet 12 may be provided so that there is no wall portion 42. In the case of there being no wall portion 42 such that the charging inlet 12 opens to the right side and the front at the right-side surface of the paper sheet processing device 11, since the partition card S (b) is set in the charging inlet 12 so as to abut the wall portion 41 and the wall portion 43 similarly to the case of the wall portion 42 being present, it is possible to favorably detect one of the identification hole groups 62*a* to 62*d* by the take-in sensor 55 similarly to the case of the wall portion 42 being present. In addition, since it is possible to set paper sheets S in the charging inlet 12 from the front surface of the device, workability is better than the case of the charging inlet 12 only opening to the right side. Furthermore, a positioning portion that is movable in the width direction of the charging inlet 12 and that positions the partition card S (b) by abutting the end of the charging inlet 12 on the opposite side of the end that abuts the wall portion 43 may be provided in the bottom portion 40 and the wall portion 41. Thereby, even when there is no wall portion 42 at the right-side surface of the paper sheet processing device 11 and the charging inlet 12 opens to the right side and the front, it is possible to more securely position the partition card S (b), and thus possible to more favorably detect one of the identification hole groups 62*a* to 62*d* by the take-in sensor 55.

Figure 13:
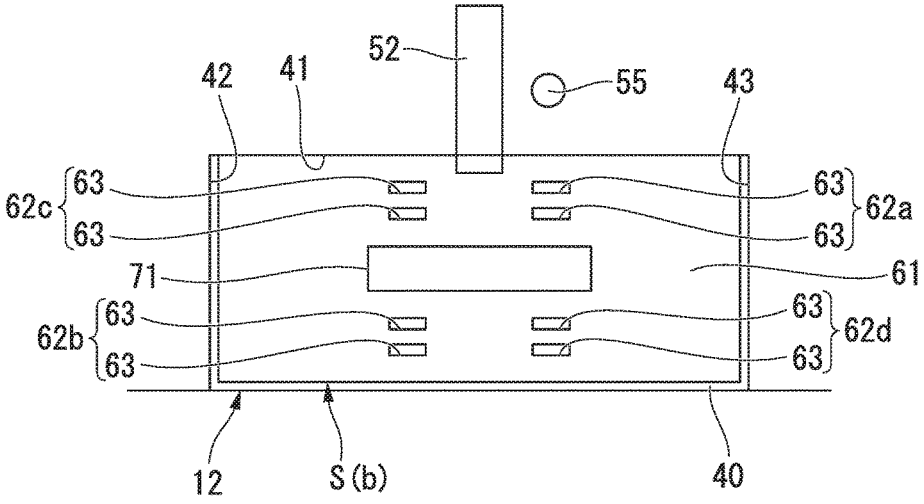
FIG. 13 is a part plan view showing the paper sheet processing device and the partition card according to the embodiment of the present invention, showing a modification of the arrangement state of the partition card to the charging inlet.

It is preferable that the partition card S (b) be disposed so as to abut the wall portion 41 and the wall portion 43 as shown in FIG. 4 and FIG. 12. However, the through holes 63 have a predetermined length with respect to the width direction of the charging inlet 12 and can cope with positional variations in the width direction of the charging inlet 12 with respect to the take-in sensor 55 when the partition card S (b) is arranged in the charging inlet 12. Therefore, as shown in FIG. 13, the partition card S (b) may be disposed in the charging inlet 12 having a gap with respect to the width direction of the charging inlet 12 between the end of the partition card S (b) and the wall portion 43.

The case of the take-in sensor 55 being arranged at a position displaced to the wall portion 43 side with respect to the central portion of the charging inlet 12 in the width direction thereof has been described as an example, but of course the take-in sensor 55 may also be arranged at a position displaced to the wall portion 42 side with respect to the central portion of the charging inlet 12 in the width direction.

In the embodiment given above, the case of the paper sheet processing device 11 being a bill receiving device that receives bills has been described as an example, but it may also be a bill receiving and dispensing device that receives and dispenses bills. The paper sheet processing device 11 may also be a coin and bill receiving device that receives coins and bills, and a coin and bill receiving and dispensing device that receives and dispenses coins and bills. In addition, the embodiment may also be applied to a paper sheet processing device that processes various types of paper sheets S other than bills, with securities, cash vouchers and the like serving as the paper sheets to be processed.

A paper sheet processing device according to an embodiment of the present invention includes: a charging inlet that takes in paper sheets in a conveyance direction, the paper sheets including at least one target sheet and a partition card overlapped on the target sheet, the partition card having a main surface portion having at least one identification hole group, the identification hole group having at least two through holes arranged along the conveyance direction; a detection unit that detects take-in of the paper sheets by the charging unit, and detects the identification hole group; and a control unit that determines a paper sheet take-in of which have been detected by the detection unit is the partition card in a case where the identification hole group has been detected by the detection unit, the control unit determining that a paper sheet take-in of which have been detected by the detection unit is the target sheet in a case where the identification hole group has not been detected by the detection unit.

In the above paper sheet processing device, the detection unit may be arranged at a position displaced in a width direction of the charging inlet from a center of the charging inlet in the width direction of the charging inlet. The identification hole group may be provided at a position displaced in a first direction from a center of the main surface portion in the first direction, the first direction being orthogonal to the conveyance direction. The first length may be equal to a second length, the first length being a length in the first direction between the identification hole group and a first end of the main surface portion in the first direction, the second length being a length in the width direction of the charging inlet between the detection unit and an end of the charging inlet in the width direction of the charging inlet.

According to the above paper sheet processing device, a first length is equal to a second length, the first length being a length in the first direction between the identification hole group and a first end of the main surface portion in the first direction, the second length being a length in the width direction of the charging inlet between the detection unit and an end of the charging inlet in the width direction of the charging inlet. Therefore, it is possible to favorably detect an identification hole group by the detection unit.

In the above paper sheet processing device, the identification hole group may include: first two identification hole groups provided at a first side in the first direction; and second two identification hole groups provided at a second side in the first direction, the second side being opposite to the first side. A third length and a fourth length may be equal to a fifth length, the third length being a length in the first direction between the first two identification hole groups and the first end of the main surface portion, the fourth length being a length in the first direction between the second two identification hole groups and a second end of the main surface portion in the first direction, the second end of the main surface portion being opposite to the first end of the main surface portion, the fifth length being a length in the width direction of the charging inlet between the detection unit and the end of the charging inlet.

According to the above paper sheet processing device, the identification hole group includes: first two identification hole groups provided at a first side in the first direction; and second two identification hole groups provided at a second side in the first direction, the second side being opposite to the first side. A third length and a fourth length are equal to a fifth length, the third length being a length in the first direction between the first two identification hole groups and the first end of the main surface portion, the fourth length being a length in the first direction between the second two identification hole groups and a second end of the main surface portion in the first direction, the second end of the main surface portion being opposite to the first end of the main surface portion, the fifth length being a length in the width direction of the charging inlet between the detection unit and the end of the charging inlet. Therefore, it is possible to detect the identification hole group by the detection unit regardless of the charging orientation of the partition card. Therefore, since there is no need to arrange the charging orientation of the partition card, the workability is good.

In the above paper sheet processing device, a position of the detection unit in the width direction of the charging inlet may be aligned with a center of the charging inlet in the width direction of the charging inlet. The identification hole group may be provided at a center of the main surface portion in a first direction orthogonal to the conveyance direction.

According to the above paper sheet processing device, a position of the detection unit in the width direction of the charging inlet is aligned with a center of the charging inlet in the width direction of the charging inlet. The identification hole group is provided at a center of the main surface portion in a first direction orthogonal to the conveyance direction. Therefore, it is possible to detect the identification hole group by the detection unit regardless of the charging orientation of the partition card. Therefore, since there is no need to arrange the charging orientation of the partition card, the workability is good.

In the above paper sheet processing device, the detection unit may be installed in a vicinity of the charging inlet, and the control unit may suspend take-in of the paper sheets in a case where the control unit has determined that a paper sheet is the partition card.

According to the above paper sheet processing device, the control unit suspends take-in of the paper sheets in a case where the control unit has determined that a paper sheet is the partition card. Therefore, it is possible to create a take-in interval between target sheets before and after the partition card, that is, between target sheets with different classifications. Thereby, during a paper jam or the like, it is possible to favorably and easily separate target sheets with different classifications. Moreover, since the detection unit is installed in a vicinity of the charging inlet, when a paper sheet is determined to be the partition card and the take-in of the paper sheets is suspended, it is possible to have the paper sheets on the downstream side of the partition card remain in the charging inlet. Thereby, it is possible to inhibit mixing together of target sheets of different classifications within the paper sheet processing device.

In the above paper sheet processing device, the paper sheets may constitute a paper sheet group, and the control unit may classify the paper sheet group from another paper sheet group.

A partition card according to an embodiment of the present invention includes: a main surface portion having at least one identification hole group, the identification hole group having at least two through holes arranged along a conveyance direction. The partition card is taken-in in the conveyance direction by a charging inlet of a paper sheet processing device. The identification hole group is detected by a detection unit of the paper sheet processing device. The partition card is identified by a control unit of the paper sheet processing in a case where the identification hole group has been detected by the detection unit of the paper sheet processing device.

In the above partition card, the detection unit may be arranged at a position displaced in a width direction of the charging inlet from a center of the charging inlet in the width direction of the charging inlet. The identification hole group may be provided at a position displaced in a first direction from a center of the main surface portion in the first direction, the first direction being orthogonal to the conveyance direction. A first length may be equal to a second length, the first length being a length in the first direction between the identification hole group and a first end of the main surface portion in the first direction, the second length being a length in the width direction of the charging inlet between the detection unit and an end of the charging inlet in the width direction of the charging inlet.

According to the above partition card, a first length is equal to a second length, the first length being a length in the first direction between the identification hole group and a first end of the main surface portion in the first direction, the second length being a length in the width direction of the charging inlet between the detection unit and an end of the charging inlet in the width direction of the charging inlet. Therefore, it is possible to have the detection unit favorably detect the identification hole group.

In the above partition card, the identification hole group may include: first two identification hole groups provided at a first side in the first direction; and second two identification hole groups provided at a second side in the first direction, the second side being opposite to the first side, and a third length and a fourth length may be equal to a fifth length, the third length being a length in the first direction between the first two identification hole groups and the first end of the main surface portion, the fourth length being a length in the first direction between the second two identification hole groups and a second end of the main surface portion in the first direction, the second end of the main surface portion being opposite to the first end of the main surface portion, the fifth length being a length in the width direction of the charging inlet between the detection unit and the end of the charging inlet.

According to the above partition card, the identification hole group include: first two identification hole groups provided at a first side in the first direction; and second two identification hole groups provided at a second side in the first direction, the second side being opposite to the first side, and a third length and a fourth length are equal to a fifth length, the third length being a length in the first direction between the first two identification hole groups and the first end of the main surface portion, the fourth length being a length in the first direction between the second two identification hole groups and a second end of the main surface portion in the first direction, the second end of the main surface portion being opposite to the first end of the main surface portion, the fifth length being a length in the width direction of the charging inlet between the detection unit and the end of the charging inlet. Therefore, it is possible to have the detection unit detect the identification hole group regardless of the charging orientation. Therefore, since there is no need to arrange the charging orientation, the workability is good.

In the above partition card, a position of the detection unit in the width direction of the charging inlet may be aligned with a center of the charging inlet in the width direction of the charging inlet. The identification hole group may be provided at a center of the main surface portion in a first direction orthogonal to the conveyance direction.

According to the above partition card, a position of the detection unit in the width direction of the charging inlet is aligned with a center of the charging inlet in the width direction of the charging inlet. The identification hole group is provided at a center of the main surface portion in a first direction orthogonal to the conveyance direction. Therefore, it is possible to have the detection unit detect the identification hole group regardless of the charging orientation to the charging inlet. Therefore, since there is no need to arrange the charging orientation, the workability is good.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A paper sheet processing device comprising:

a charging inlet that includes a take-in roller that takes in second paper sheets in a conveyance direction into the paper sheet processing device after taking-in first paper sheets, the second paper sheets including at least one target sheet and a partition card, the take-in roller taking in the at least one target sheet after taking in the partition card, the partition card having a main surface portion having at least one identification hole group, the identification hole group having at least one through hole;

a detection unit that detects light transmission and light shielding, the detection unit being arranged at a position near the take-in roller and being displaced by a predetermined distance in a width direction of the charging inlet with respect to the take-in roller, the width direction being perpendicular to the conveyance direction, the detecting unit, by detecting light shielding, detecting take-in of the second paper sheets by the charging unit, the detection unit, by detecting light transmission, detecting the identification hole group;

a conveying unit that conveys the second paper sheets which have been taken-in after conveying the first paper sheets which have been taken-in; and a control unit that determines that one of the second paper sheets is the partition card in a case where the detection unit has detected the identification hole group from the one of the second paper sheets, wherein in a case where the control unit has determined that the one of the second paper sheets is the partition card, the control unit suspends taking-in of all of the second paper sheets, including the partition card, while causing the conveying unit to continue conveyance of the first paper sheets that have been already taken-in by the take-in roller, wherein in a case where the control unit has determined that the conveyance of the first paper sheets has been finished, the control unit restarts taking-in of all of the second paper sheets.

2. The paper sheet processing device according to claim 1, wherein the detection unit is arranged at a position displaced in the width direction of the charging inlet from a center of the charging inlet in the width direction of the charging inlet, and the identification hole group is provided at a position displaced in a first direction from a center of the main surface portion in the first direction, the first direction being orthogonal to the conveyance direction.

3. The paper sheet processing device according to claim 2, wherein the identification hole group includes: a first identification hole group provided at a first side in the first direction; and a second identification hole group provided at a second side in the first direction, the second side being opposite to the first side.

4. The paper sheet processing device according to claim 1, wherein a position of the detection unit in the width direction of the charging inlet is aligned with a center of the charging inlet in the width direction of the charging inlet, and the identification hole group is provided at a center of the main surface portion in a first direction orthogonal to the conveyance direction.

5. The paper sheet processing device according to claim 1, wherein the control unit is configured to determine that another one of the second paper sheets is the target sheet in a case where the detection unit has not detected the identification hole group from said another one of the second paper sheets.

* * * * *